US010900243B2

(12) United States Patent
Koethe

(10) Patent No.: US 10,900,243 B2
(45) Date of Patent: Jan. 26, 2021

(54) TWO-PIECE TRIM ASSEMBLY FOR SIDING ON BUILDINGS

(71) Applicant: Terry Koethe, Algona, IA (US)

(72) Inventor: Terry Koethe, Algona, IA (US)

( * ) Notice: Subject to any disclaimer, the term of this patent is extended or adjusted under 35 U.S.C. 154(b) by 0 days.

(21) Appl. No.: 16/421,941

(22) Filed: May 24, 2019

(65) Prior Publication Data

US 2020/0370311 A1 Nov. 26, 2020

(51) Int. Cl.
*E04F 19/02* (2006.01)
*E04F 19/06* (2006.01)

(52) U.S. Cl.
CPC ..... *E04F 19/061* (2013.01); *E04F 19/062* (2013.01)

(58) Field of Classification Search
CPC ..... E04F 19/061; E04F 19/062; E04F 19/064; E04F 19/06; E04F 19/022; E04F 13/073; E04F 13/0733; E04F 13/0864; E04F 13/0862; E04D 13/158; E04D 13/1585
USPC ..... 52/287.1, 288.1
See application file for complete search history.

(56) References Cited

U.S. PATENT DOCUMENTS 3,181,275 A * 5/1965 Wood ..... E04D 13/158 52/73
3,485,001 A * 12/1969 Miller ..... E04B 2/76 52/281
3,525,188 A * 8/1970 Torbett ..... E04F 19/064 52/288.1
3,735,538 A * 5/1973 Ramins ..... E04D 13/1585 52/94
4,127,974 A * 12/1978 Wendt ..... E04B 2/7457 52/287.1
4,189,885 A * 2/1980 Fritz ..... E04F 13/0842 52/278
4,339,898 A * 7/1982 Pichette ..... E04D 13/158 52/278
4,411,120 A * 10/1983 Ellis ..... E04D 1/30 52/287.1
4,461,128 A * 7/1984 Knoebl ..... E04D 13/158 52/748.11
4,497,150 A * 2/1985 Wendt ..... E04F 19/06 52/242
5,377,463 A * 1/1995 Howe ..... E04D 13/158 52/200
5,392,579 A * 2/1995 Champagne ..... E04D 1/34 52/520
5,537,791 A * 7/1996 Champagne ..... E04F 13/0864 52/489.1
5,560,170 A * 10/1996 Ganser ..... E04F 13/0864 52/212

(Continued)

*Primary Examiner* — Kyle J. Walraed-Sullivan
(74) *Attorney, Agent, or Firm* — McKee, Voorhees & Sease, PLC

(57) ABSTRACT

A two-piece trim assembly covers the ends of siding used on building exterior walls. The trim assembly includes an L-shaped base and L-shaped cover. The base is secured to the wall first, then the siding strips are attached to the wall such that the ends of the strips are in close proximity to the upstanding leg of the base. Then the cover is installed so that one leg overlies the upstanding leg of the base and the front leg overlies the corners of the siding strips. The inner surface of the base and the outer surface of the cover or color coordinated with the siding strip, with the non-colored surfaces of the base and cover being hidden from view when the base and cover are assembled.

19 Claims, 8 Drawing Sheets

(56) References Cited

U.S. PATENT DOCUMENTS 5,644,877 A * 7/1997 Wood ..... E04B 2/7407 52/126.3
5,657,585 A * 8/1997 Zaccagni ..... E04D 13/158 52/518
5,694,726 A * 12/1997 Wu ..... E04F 19/0436 174/504
5,829,206 A * 11/1998 Bachman ..... E04D 13/158 52/94
5,836,113 A * 11/1998 Bachman ..... E04D 13/158 52/94
6,115,982 A * 9/2000 Lindenberg ..... A47B 77/022 52/272
6,311,442 B1 * 11/2001 Watanabe ..... E04B 2/707 156/91
6,360,508 B1 * 3/2002 Pelfrey ..... E04F 13/0864 52/198
D473,662 S * 4/2003 Shaw ..... D25/119
6,625,941 B2 * 9/2003 Shaw ..... E04F 13/0864 52/211
6,782,666 B1 * 8/2004 Condon ..... E04D 13/158 52/93.2
6,865,849 B1 * 3/2005 Mollinger ..... E04F 13/0864 52/716.2
6,883,288 B1 * 4/2005 Harbin ..... E04F 13/18 52/521
6,904,726 B2 * 6/2005 Heard ..... E06B 1/6015 49/504
6,988,345 B1 * 1/2006 Pelfrey ..... E04F 13/0864 52/519
7,204,062 B2 * 4/2007 Fairbanks ..... E04F 13/0864 52/522
7,287,354 B2 * 10/2007 Rivers ..... E04F 19/00 174/504
7,392,623 B2 * 7/2008 Back ..... E04B 7/04 52/200
7,451,576 B2 * 11/2008 Barone ..... E04F 21/0069 403/402
7,487,623 B2 * 2/2009 Rodolofo ..... E04D 13/152 52/288.1
7,685,781 B1 * 3/2010 Hatch ..... E04B 1/34342 52/169.12
7,685,787 B1 * 3/2010 Mollinger ..... E04F 13/0876 52/547
7,726,092 B1 * 6/2010 Pelfrey ..... E06B 1/702 52/717.01
7,743,561 B1 * 6/2010 Frederick ..... E04D 13/064 52/11
7,743,581 B2 * 6/2010 Shaw ..... E04D 13/15 52/741.1
D624,212 S * 9/2010 Sawyer ..... D25/136
7,836,641 B2 * 11/2010 Back ..... E04D 13/1478 52/90.1
7,934,352 B1 * 5/2011 Mollinger ..... E04F 17/00 52/748.1
7,946,081 B1 * 5/2011 Frederick ..... E04D 13/064 52/11
7,958,691 B1 * 6/2011 Newhouse ..... E04F 19/022 312/111
7,984,597 B2 * 7/2011 Mollinger ..... B29C 48/904 52/555
8,006,455 B1 * 8/2011 Mollinger ..... E04F 13/26 52/519
8,104,234 B1 * 1/2012 Sawyer ..... E04F 13/0864 52/96
8,136,323 B2 * 3/2012 King ..... E04F 13/185 52/524
8,191,319 B2 * 6/2012 Nark ..... E04D 13/103 52/95
8,205,397 B2 * 6/2012 Nark ..... E04D 13/103 52/95
8,225,567 B1 * 7/2012 Mollinger ..... E04F 13/0864 52/302.4
8,225,568 B1 * 7/2012 Mollinger ..... E04F 13/0871 52/302.4
8,336,269 B1 * 12/2012 Mollinger ..... E04F 13/007 52/302.4
8,381,472 B1 * 2/2013 Fleenor ..... E04F 13/0825 52/459
8,490,336 B2 * 7/2013 Nark ..... H05B 3/06 52/13
8,495,844 B1 * 7/2013 Johnson, Sr. ..... E04F 19/0436 52/238.1
8,713,890 B2 * 5/2014 Pierret ..... E04F 13/0733 52/718.01
8,782,960 B2 * 7/2014 Nark ..... E04D 13/103 52/13
8,795,813 B2 * 8/2014 Olvey ..... E04C 2/292 428/167
9,045,899 B2 * 6/2015 Pilz ..... E04B 2/7411
9,187,912 B2 * 11/2015 Pulte ..... E06B 1/34
9,428,915 B2 * 8/2016 Nark ..... E04D 13/103
9,493,945 B2 * 11/2016 Bottin ..... E04C 2/46
9,556,973 B2 * 1/2017 Rumsey ..... H05B 3/06
D822,852 S * 7/2018 Jackson ..... D25/119
D834,727 S * 11/2018 Jackson ..... D25/119
D834,728 S * 11/2018 Jackson ..... D25/119
D835,299 S * 12/2018 Jackson ..... D25/119
D853,587 S * 7/2019 Jackson ..... D25/119
D853,588 S * 7/2019 Jackson ..... D25/119
D853,589 S * 7/2019 Jackson ..... D25/119
2002/0108327 A1 * 8/2002 Shaw ..... E04F 13/0864 52/211
2002/0178666 A1 * 12/2002 Jurvis ..... E04F 19/02 52/233
2004/0074175 A1 * 4/2004 Tierney ..... E04F 13/0864 52/255
2007/0119107 A1 * 5/2007 Shaw ..... E04D 13/15 52/287.1
2008/0127585 A1 * 6/2008 Ruhlmann ..... E04F 15/02447 52/302.3
2009/0056235 A1 * 3/2009 Morsching ..... E04B 5/00 52/58
2009/0056252 A1 * 3/2009 Taylor ..... E04F 19/022 52/287.1
2010/0212234 A1 * 8/2010 Monteer ..... E04F 19/06 52/95
2012/0066989 A1 * 3/2012 Pilz ..... E04B 2/7411 52/232
2013/0255171 A1 * 10/2013 Rutherford ..... E04F 13/06 52/287.1
2014/0260056 A1 * 9/2014 Stanfill ..... E04F 13/0894 52/588.1
2019/0127992 A1 * 5/2019 Galas ..... F16B 5/125

* cited by examiner

TWO-PIECE TRIM ASSEMBLY FOR SIDING ON BUILDINGS

FIELD OF THE INVENTION

The invention relates to a two-piece trim assembly for use on the ends of siding strips used on buildings, such as exterior metal siding. The invention also relates to a method of installing the siding strips onto the building wall with the two-piece trim assembly.

BACKGROUND OF THE INVENTION

FIGS. 1 and 8 show a prior art trim piece 10 for siding 11, such as metal siding, on the exterior of a commercial or residential building. Conventional building siding used on building exteriors typically uses a one-piece, J-shaped trim piece or mold 10 to enclose the ends of the siding strips 11. The J-shaped trim 10 has a back or base piece 12 which is mounted to the building wall. The trim piece 10 includes an upstanding leg or web 14 which may have different heights to accommodate different profiles of the siding strips. The trim piece 10 has a front face 16 extending perpendicular to the web 14, and typically extending approximately 1 inch. The base 12, the web 14, and the front face 16 of the trim piece 10 form a channel 18 for receiving the end 20 of the siding 11.

The prior art trim piece 10 has been used for many years but has many problems. First, during the installation process, if a trim piece 10 is used on both ends 20 of the siding 11, as shown in FIG. 8, the siding must be cut short so as to fit between the opposing channels 18, which leaves a substantial gap 22, of approximately one half the length of the front face 16 at each end of the siding. For example, if the front face 16 is one inch long, the gap 22 is approximately a ½-⅝ inch-wide at each end 20. The gap 22 allows the siding 11 to slide within the opposing channels 18, which is undesirable. This installation process, wherein the siding 11 is slipped beneath the front face 16 on one end and then is slid back beneath the front face 16 at the opposite end, can scratch or dent the front of the siding 11, with such damage to the front face of the siding being visible.

Another problem with the J-trim piece 10 is that the front face 16 overlaps the siding 11, so as to prevent a sealant, such as caulking, to be applied to the end 20 of the siding to seal against moisture and air penetration. Often, foam material is inserted into the channel 18 so as to create an air dam, and thereby minimize air leakage or passage. Adding the foam is another time-consuming step that adds more cost to the siding project.

Furthermore, the one-piece trim 10 is normally only colored on the outer surface, such that the exterior of the front face 16 has a color which matches, coordinates, or complements the color of the siding 11, while the interior surface of the trim piece 10 is usually white or gray. This bright color of the interior surface of the trim piece 10 is often visible, and particularly stands out against dark-colored trim. Thus, colored inserts are often used to cover the white or gray inner surface of the J-trim piece 10, which adds to costs and installation time.

Therefore, there is a need in the industry for an improved trim assembly for covering the ends of siding strips on building exteriors which overcomes the problems of the prior art.

Accordingly, the primary objective of the present invention is a provision of a two-piece trim assembly for use on the ends of building siding material which avoids the problems of conventional one-piece trim systems.

Another objective of the present invention is the provision of a two-piece trim assembly for use with metal siding which simplifies installation of the siding on buildings so as to save time and costs.

A further objective of the present invention is the provision of a two-piece trim assembly for metal siding which allows the ends of the siding to be easily sealed against air and moisture.

Still another objective of the present invention is the provision of a two-piece trim assembly which permits the siding to be cut for a close fit minimizing the gap between the ends of the siding strips and the trim assembly.

Yet another objective of the present invention is the provision of a two-piece trim assembly for siding having colored interior and exterior surfaces to match or contrast the siding color.

A further objective of the present invention is the provision of a two-piece trim kit having increased integrity and appearance, while saving installation time and costs, and improving profitability for the installer.

Yet another objective of the present invention is the provision of a two-piece trim assembly for metal and other siding on buildings which can be nested closely together for improved shipping and transportation.

Still another objective of the present invention is the provision of a method of installing siding strips onto a building wall using a two-piece trim assembly which simplifies installation and reduces installation time and cost.

These and other objectives will become apparent from the following description of the invention.

SUMMARY OF THE INVENTION

A two-piece trim assembly is provided for covering the ends of metal or other siding used on building exteriors. The trim assembly includes an L-shaped base with the first leg adapted to reside against the building wall and a second leg extending perpendicularly to the first leg. The trim assembly further includes an L-shaped cover having first and second perpendicular legs. The cover is positioned adjacent the base, such that the first leg of the cover overlies the second leg of the base, and the second leg of the covered is spaced from the first leg of the base to form a channel in which the end of the siding resides. The edges of the base and cover may be hemmed. The outer surface of the cover and the inner surface of the base are colored to match the color of the siding, or in complementary contrast to the siding color.

The siding installation method begins by fastening the first leg of the base to the building wall. The siding strips are cut to length, such that the ends of the siding reside closely adjacent to the second leg of the base. The cover is then positioned over the ends of the siding strips so that the ends are captured between the base in the cover. If desired, a sealant, such as caulking, can be applied to the ends of the siding strips before the cover is installed so as to prevent or minimize air and moisture leakage behind the siding strips.

DETAILED DESCRIPTION OF THE PREFERRED EMBODIMENTS

Figure 1:
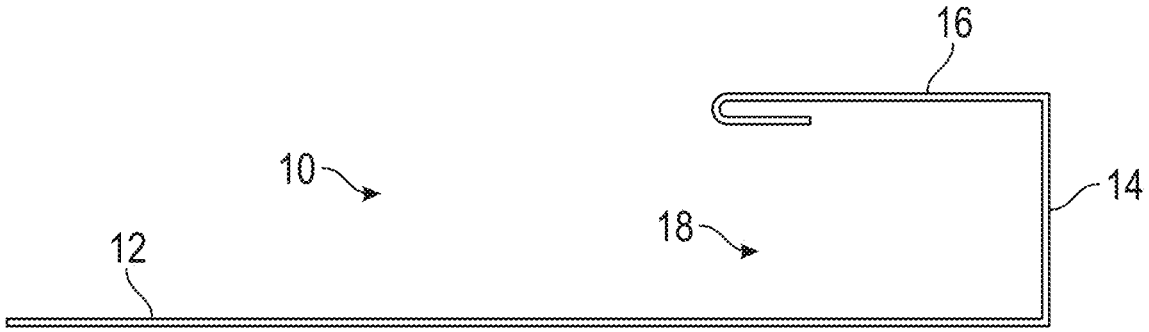
FIG. 1 Prior Art
FIG. 1 is a side elevation view of a prior art, one-piece, J-shaped trim piece for use with metal siding.
Figure 2:
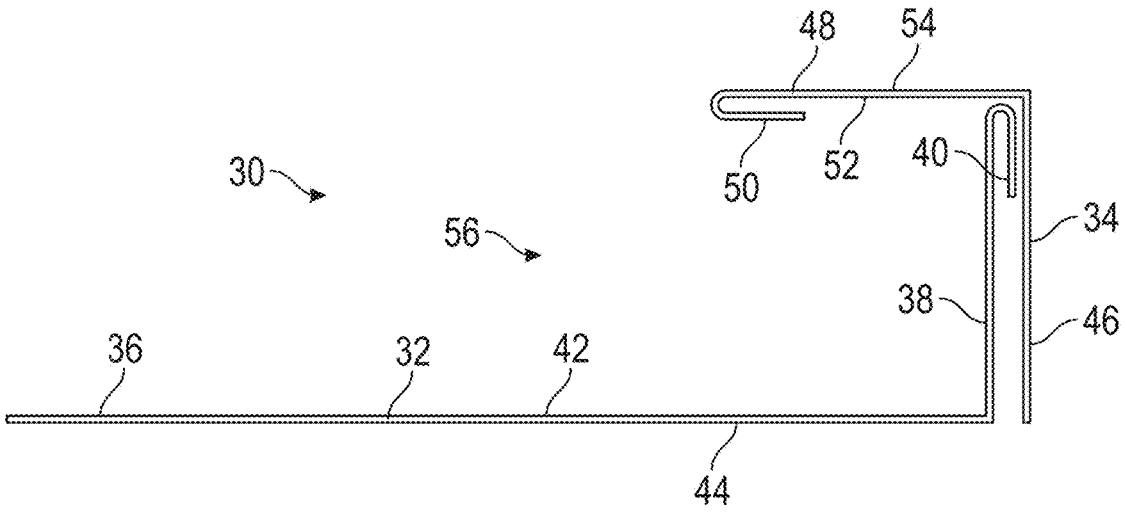
FIG. 2 is as side elevation view of the two-piece trim assembly for use with metal and other siding strips, according to the present invention.
Figure 3:
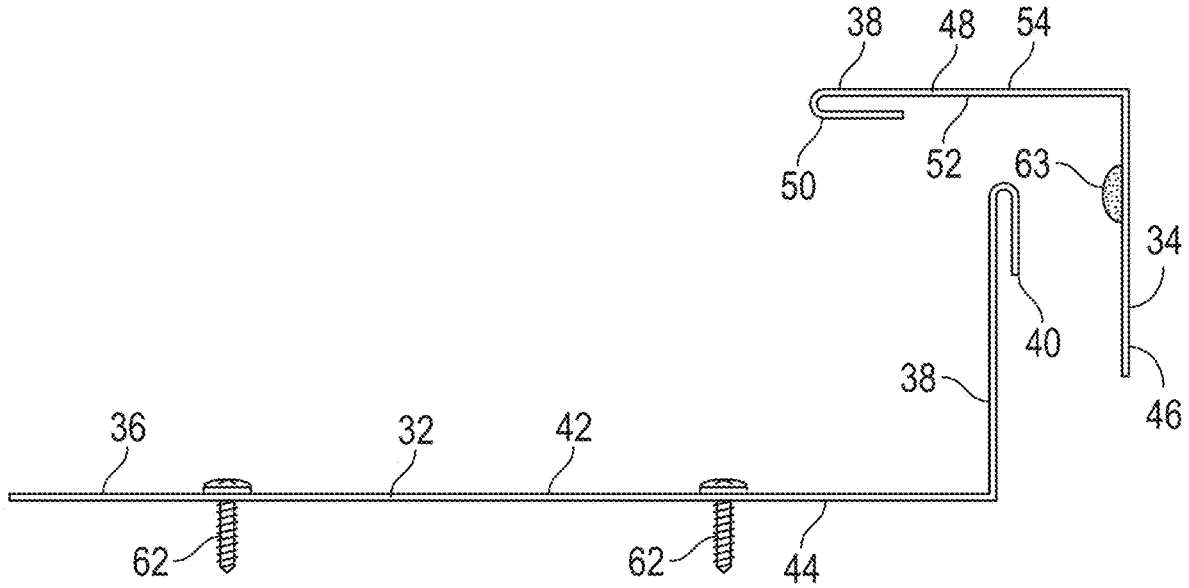
FIG. 3 is an exploded view of the two-piece trim assembly of the present invention.

The two-piece trim assembly for use in covering the ends of siding strips on buildings, according to the present invention, is generally designated by the reference 30 in the drawings. The trim assembly 30 includes a base piece 32 and a cover piece 34.

Figure 5:
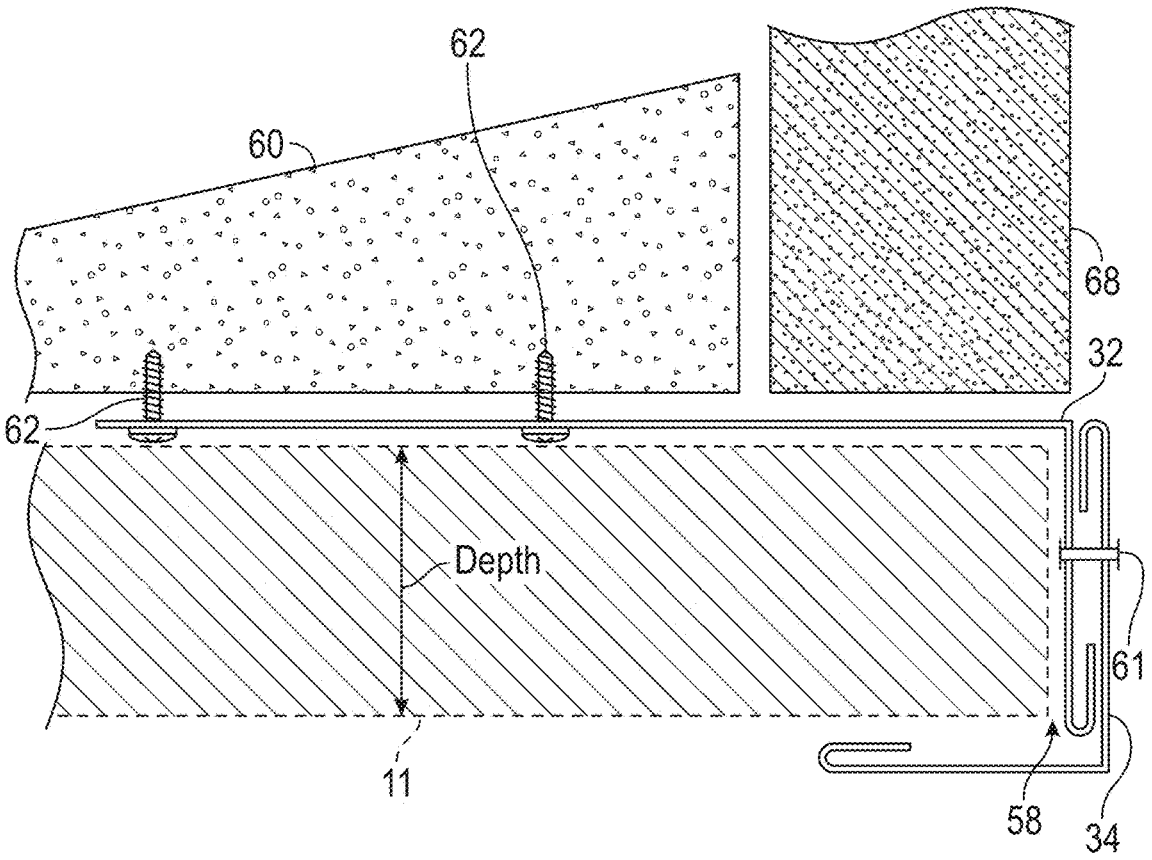
FIG. 5 is another view showing the two-piece trim assembly installed on a building wall.

The base piece 32 is L-shaped, with an elongated first leg 36 and a shorter second leg 38 extending perpendicularly from the first leg 36. The outer or terminal end of the second leg 38 is hemmed to hold edge ridges and assist with installation of the cover piece. Also, the length or height of the leg 38 is determined by the depth of the siding to be installed, such as the strips 11, as shown in FIG. 5. This also effects the length of the leg 46. The base piece 32 includes opposite inner and outer surfaces 42, 44. At least the inner surface 42 is colored so as to match the color of the siding or may be a complementary or contrasting color to the siding color.

The cover piece 34 is L-shaped, with a first leg 46 and a second leg 48 perpendicular to the first leg 46. The terminal ends of the legs 46, 48 may include a hem 50, which is optional. The cover piece 34 has opposite inner and outer surfaces 52, 54. At least the outer surface 54 is colored so as to match, complement, or contrast the color of the siding.

The base 32 and the cover 34, when assembled, form a channel 56 in which the end 20 of the siding 11 resides. As seen in FIGS. 4-7, the end 20 of the siding 11 is closely adjacent to the second leg 38 of the base piece 32, with a minimal gap 58 therebetween. For example, the gap may be ⅛-3/16 inch. The second leg 48 of the cover 34 forms a front face extending over the front corner of the siding 11.

Installation of the siding and trim assembly 30 on the building wall 60 is a faster and simpler process, as compared to use of the conventional trim piece 10. First, the base piece 32 is fastened to the wall in any convenient manner, such as with screws 32. Then, after the siding strips 11 are cut to length, each siding strip is positioned over the first leg 36 of the base piece 32. As seen in the drawings, the length of the siding strip is such that the end 20 is closely adjacent the second leg 38 of the cover of the base piece 32 with a minimal gap 58. After each siding strip 11 is attached to the wall 60 using conventional fasteners, the cover piece 34 is positioned with the first leg 46 overlying the second leg 38 of the base piece 32, and the second leg 48 overlying the front corners of the siding strips. The second or front leg 48 may be riveted or otherwise attached to the siding strip with a fastener 61 to secure the cover piece 34 in place.

If desired, before the cover piece 34 is installed, a sealant, such as a caulk material, may be applied to the gap 58 so as to minimize or preclude air and moisture leakage behind the siding strips. Also, if desired, a sealant 63 can be applied to the inner surface 52 of the first leg 46 of the cover piece 34 as to provide a seal between the first leg 46 of the cover 34 and the second leg 38 of the base 32.

Figure 4:
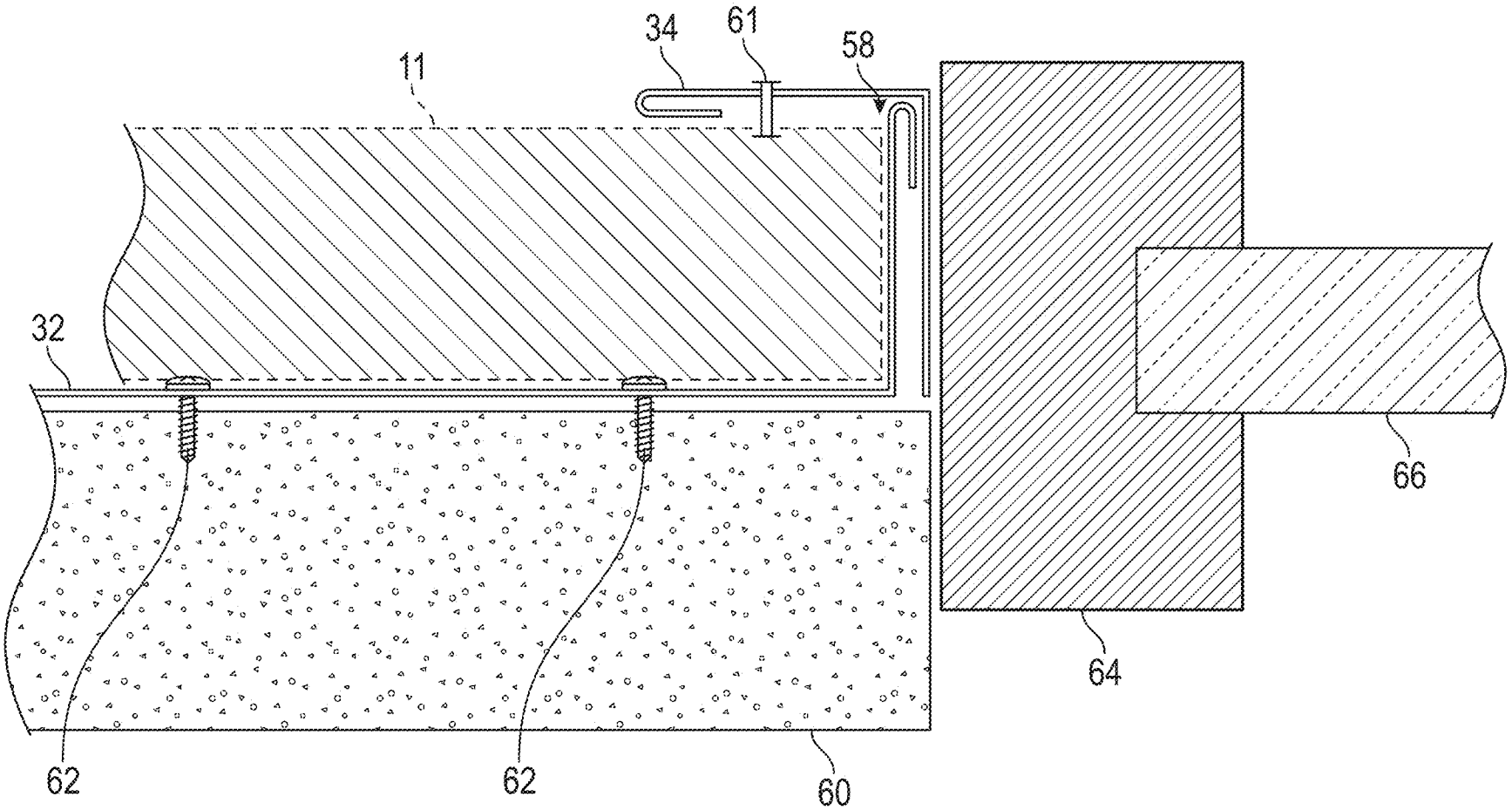
FIG. 4 is a side elevation view of the two-piece trim assembly as installed with a siding strip.
Figure 6:
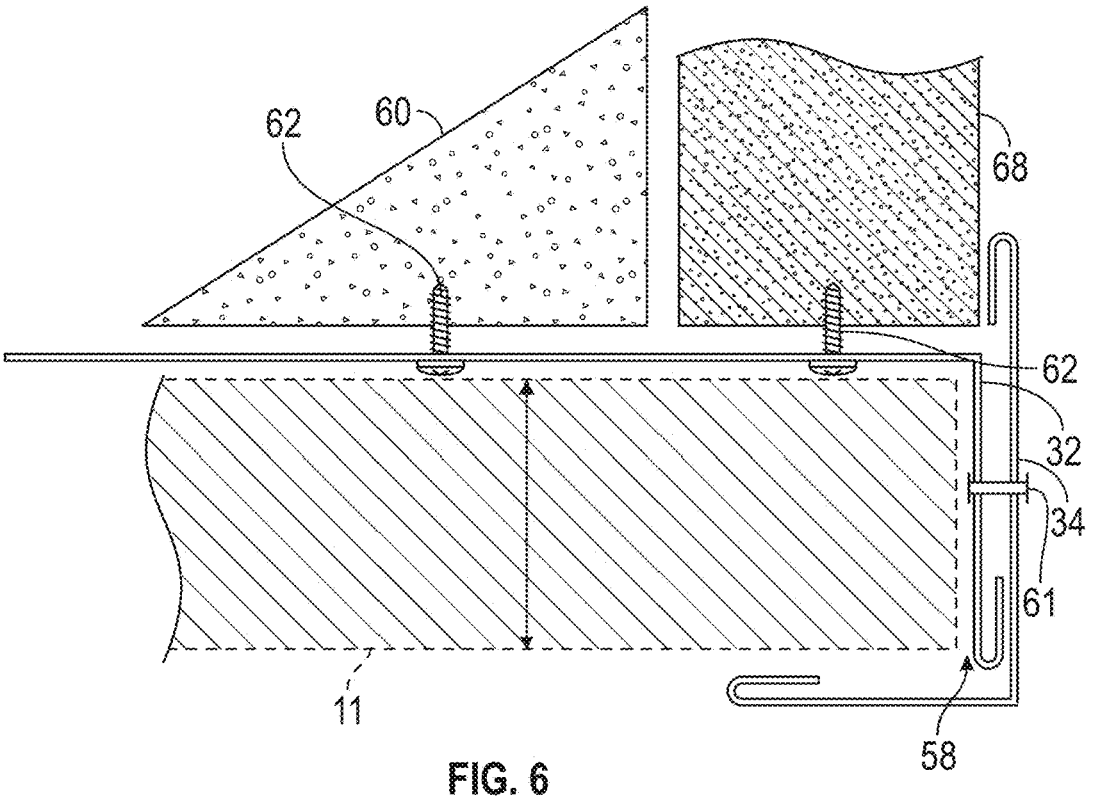
FIG. 6 is a view of an alternative embodiment of the two-piece trim assembly installed on a building.
Figure 7:
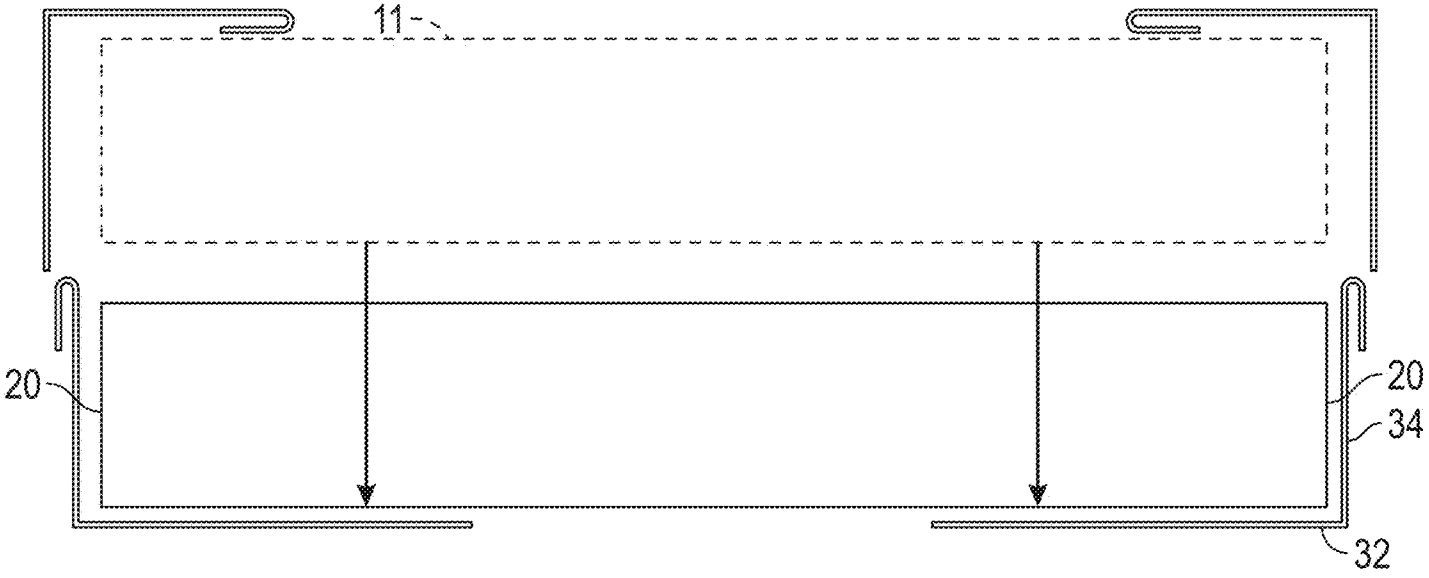
FIG. 7 is a sectional view showing the two-piece trim assembly installed on opposite ends of a siding strip.

As seen in FIGS. 4-6, the two-piece trim assembly 30 may be used in various applications, including around a window having a frame 64 and glass 66 (FIG. 4), or at a corner of a building, including those with a brick veneer 68 (FIGS. 5-6). Also, it is understood that the dimensions of the base piece 32 and the cover piece 34 may vary, according to the application. For example, as seen in FIG. 5, the first leg 46 of the cover piece 34 stops short of the brick 68, whereas in FIG. 6, the first leg 46 of the cover piece 34 extends slightly over the brick 68.

Figure 9:
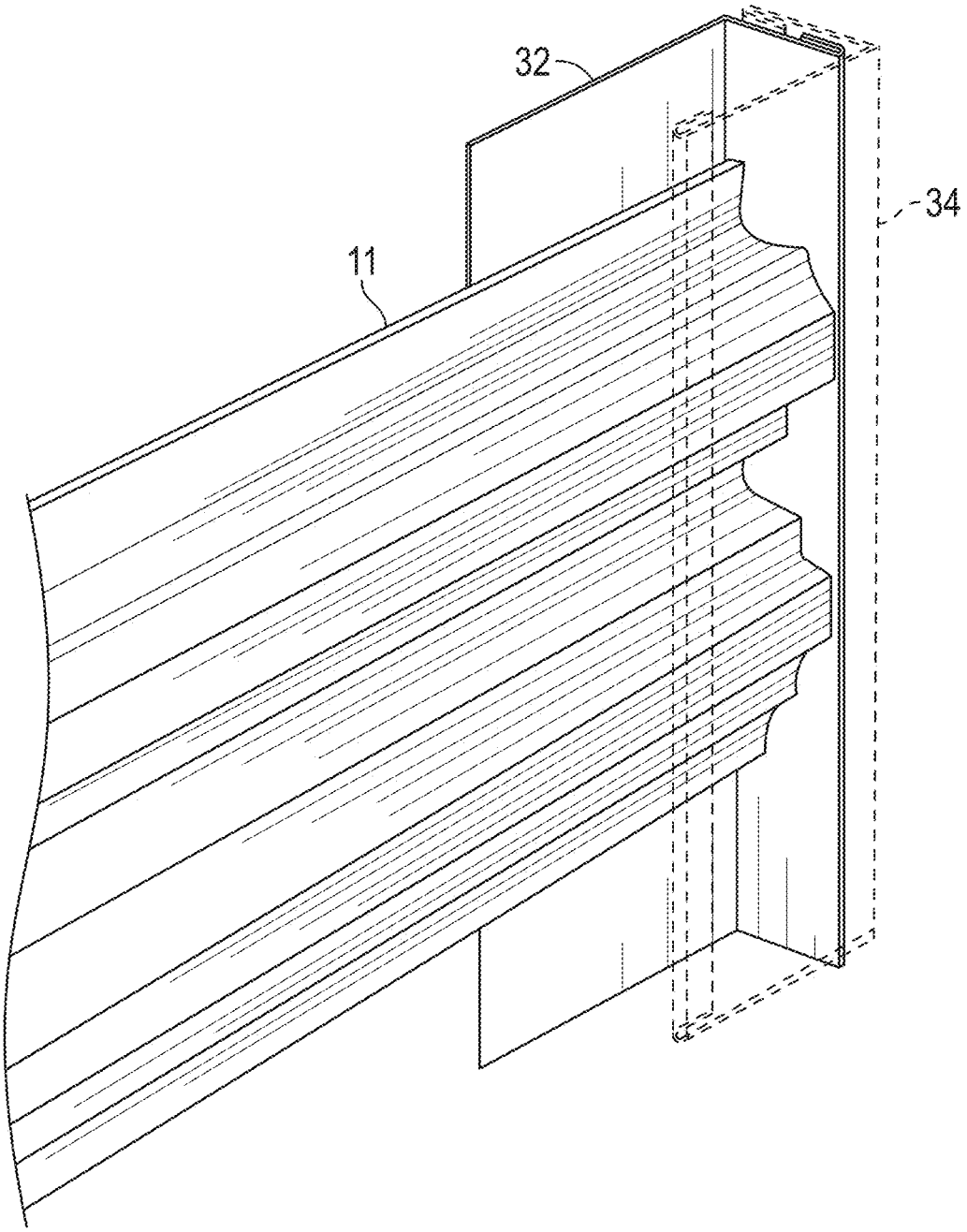
FIG. 9 is a perspective view showing the two-piece trim assembly of the present invention installed on contoured metal siding.
Figure 10:
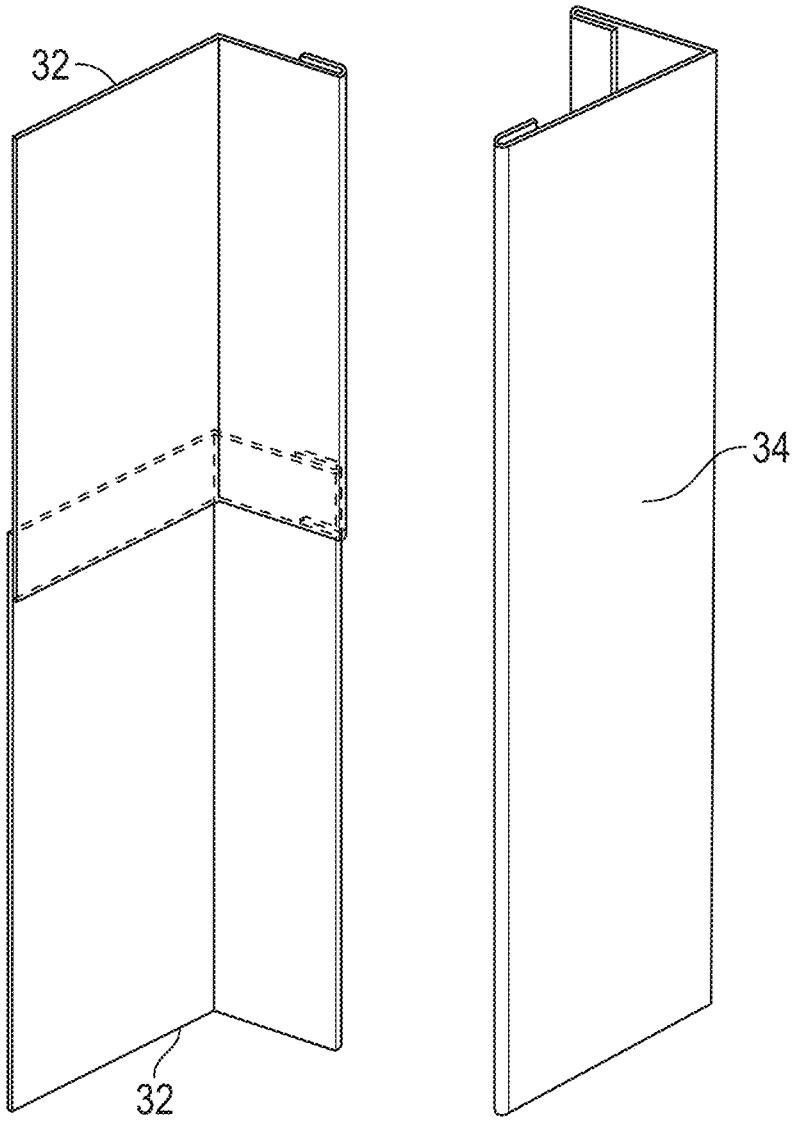
FIG. 10 is a perspective view of the two-piece trim assembly showing adjacent base pieces overlapped so as to create flashing for drainage.

The two-piece trim assembly 30 can be used in both horizontal and vertical orientations. In a vertical orientation, such as shown in FIG. 9, depending upon the height being covered, two or more base pieces 32 may be utilized, with adjacent ends overlapping (FIG. 10) so as to provide flashing for proper moisture drainage. Then, a cover piece 34 can be offset from the base pieces 32, so as to cover the overlap joint between the adjacent base pieces 32. Such an overlap of adjacent trim pieces is not possible with the conventional J-trim piece 10, without slightly deforming the J-shaped channel and without being visible on the short leg of the J which overlaps the ends of the siding.

Preferably, the length of this first leg 46 of the cover piece 34 is slightly less than the length of the second leg 38 of the base piece 32 so that when the base and cover pieces 32, 34 are assembled, there is no pinch point against the wall 60, particularly if the first leg 46 is hidden from view. If there is no wall to create a pinch point for the first leg, then preferably the leg 46 has a length to match the length of the second leg 38 of the base piece 32. The height of the second leg 38 of the base piece depends on the thickness of the siding strip 11. For example, a substantially contoured siding strip such as that shown in FIG. 9 will require a deeper channel 56 than a flatter or less contoured siding strip.

Figure 8:
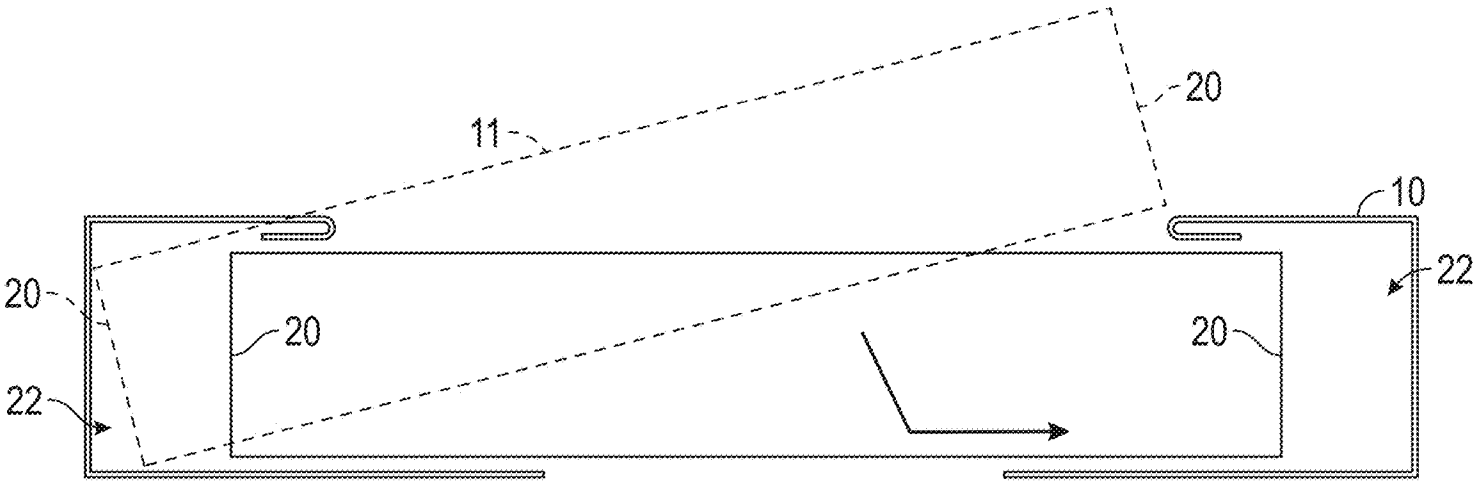
FIG. 8 Prior Art
FIG. 8 is a sectional view showing a prior art one-piece trim assembly on opposite ends of a siding strip.

The two-piece trim assembly 30 of the present invention has many advantages over the prior art one-piece trim component 10. First, the installation process is faster, since the cover piece 34 is removed so that there is no front face or leg blocking the end of the side strip as the siding strips are positioned on the base piece 32. The open front of the base piece 32 also eliminates risk of scratching or damaging the siding strip during installation, since the lengthwise sliding adjustments is eliminated, as compared to prior art process shown in FIG. 8.

Another advantage of the two-piece trim assembly 30 is that all visible surfaces of the trim assembly are colored. Thus, there is no white or gray exposed surface, as with the channel 18 of the J-trim piece 10. Thus, the two-piece trim assembly 30 eliminates the need for colored inserts which are required to cover the uncolored siding surface of the J-trim piece.

The two-piece trim assembly 30 also eliminates the need for foam used with the J trim 10 to block air or moisture, since the gap 58 between the ends of the siding strips in the base piece 32 is significantly smaller than the gap 22 for the ends of the siding strips in the J-trim piece 10. Also, with the two-piece trim assembly 30, a sealant can be applied in the gap 58, if desired, before the cover piece 34 is installed. Such sealing cannot be done with the J-trim piece 10, since the end of the siding strip is covered by the front face 16 of the trim piece 10.

Figure 11:
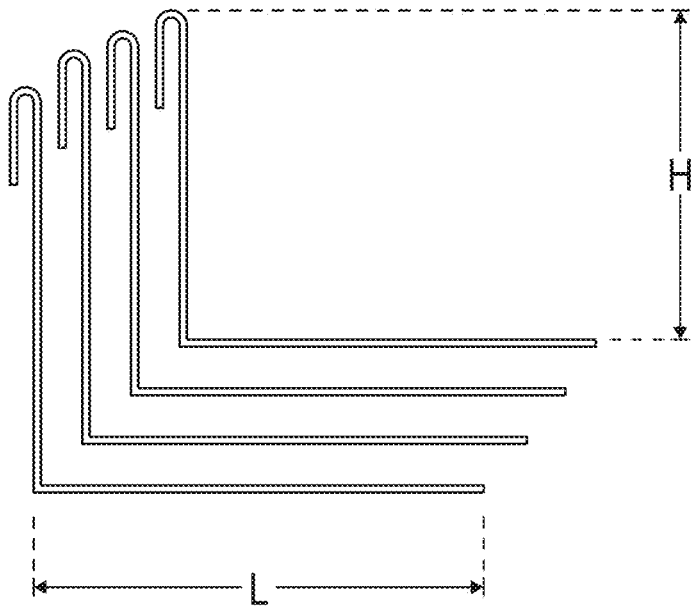
FIG. 11 is a view showing the stacked nesting of the two-piece trim assembly, according to the present invention.
Figure 12:
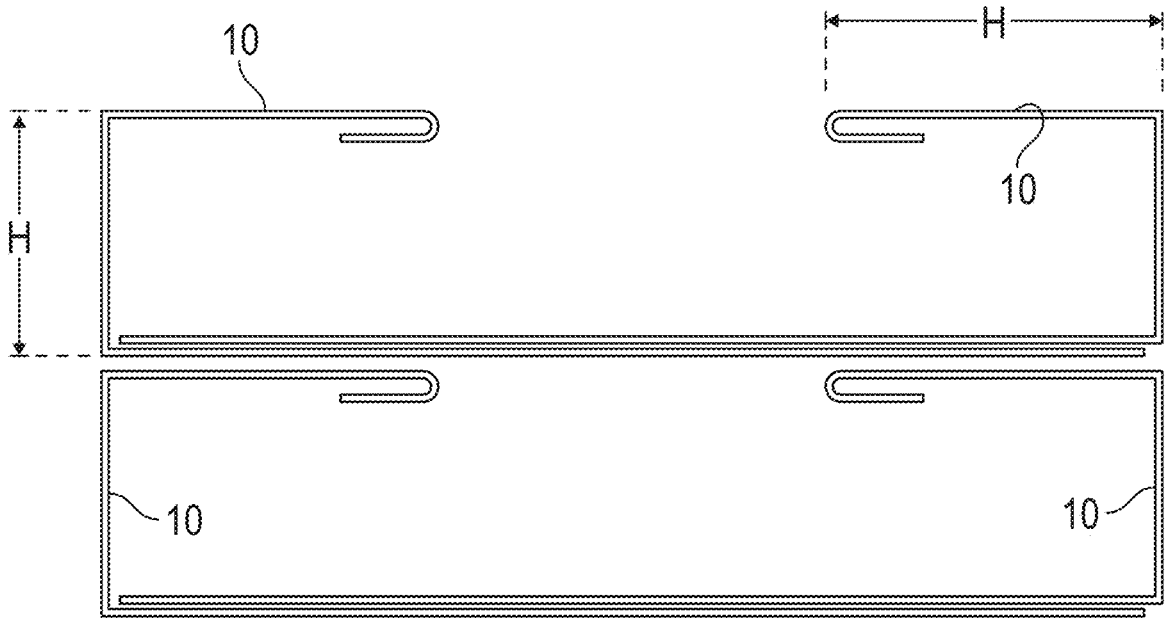
FIG. 12 Prior Art
FIG. 12 is a schematic showing stacking of the prior art one-piece J-trim.

Furthermore, the L-shaped base piece 32 and L-shaped cover piece 34 can be easily stacked in close proximity and utilizing a minimum amount of space (see FIG. 11), as compared to the stacking of the same number of J-shaped trim pieces 10 (see FIG. 12). The close nesting of the pieces 32, 34 allows for more compact packing, so as to reduce shipping and transportation costs.

While in the preferred embodiment the two-piece trim assembly is made of metal which is bent to the desired dimensions for use with metal siding, it is contemplated that a similar two-piece trim assembly can be extruded from vinyl for use with vinyl siding. Such a vinyl trim assembly may include a snap fit with detents on the base or cover pieces, or another form of a male and female coupling between the base and cover pieces.

The two-piece trim assembly 30 of the present invention improves the integrity of and appearance of the finished siding project, while saving time and money, and improving profitability.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An exterior two-piece trim assembly for an end of exterior siding on a building wall, comprising:

an elongated L-shaped base have a first leg adapted to be fastened to the building wall and a second leg extending perpendicular to the first leg away from the building wall;

an elongated L-shaped cover having first and second perpendicular legs;

the L-shaped cover being adapted to be positioned adjacent the L-shaped base with the first leg of the L-shaped cover overlying the second leg of the L-shaped base and the second leg of the L-shaped cover being spaced from the first leg of the L-shaped base to form an elongated, continuous channel there between in which the end of the exterior siding resides; and a fastener extending through the L-shaped cover and into the exterior siding to hold the L-shaped cover in position.

2. The exterior two-piece trim assembly of claim 1 wherein the second leg of the L-shaped base terminates in a hem.

3. The exterior two-piece trim assembly of claim 2 wherein the hem is turned outwardly.

4. The exterior two-piece trim assembly of claim 1 wherein the second leg of the L-shaped cover terminates in a hem.

5. The exterior two-piece trim assembly of claim 4 wherein the hem turns inwardly.

6. The exterior two-piece trim assembly of claim 4 wherein the first leg of the L-shaped cover terminates in a hem.

7. The exterior two-piece trim assembly of claim 6 wherein the hem is turned inwardly.

8. The exterior two-piece trim assembly of claim 1 wherein the L-shaped base has opposite inner and outer surfaces and the inner surface is colored to match a siding color.

9. The exterior two-piece trim assembly of claim 8 wherein the L-shaped cover has an outer surface colored to match color of the exterior siding.

10. The exterior two-piece trim assembly of claim 1 wherein the L-shaped base has an inside surface and the L-shaped cover has an outside surface, with the inside surface and outside surface having matching colors.

11. The exterior two-piece trim assembly of claim 1 wherein the channel extends vertically.

12. The exterior two-piece assembly of claim 1 wherein the channel has a longitudinal axis extending vertically in a first configuration and horizontally in a second configuration.

13. A trim assembly to cover ends of exterior siding strips on a building, comprising:

an elongated L-shaped base;

an elongated L-shaped cover;

the L-shaped base and L-shaped cover being separate pieces and assembled to form an elongated, continuous J-shaped channel in which the ends of the exterior siding strips reside;

the J-shaped channel having a longitudinal axis extending vertically in a first application and horizontally in a second application; and fasteners extending through the L-shaped cover and into the exterior siding strips.

14. The trim assembly of claim 13 wherein the J-shaped channel has a back leg on the base and a front leg on the L-shaped cover.

15. The trim assembly of claim 14 wherein the J-shaped channel has a middle leg between the back and front legs.

16. The trim assembly of claim 13 wherein the J-shaped channel has inside and outside surfaces with matching colors.

17. The trim assembly of claim 13 wherein the L-shaped base has a hemmed edge.

18. The trim assembly of claim 13 wherein the L-shaped cover has a hemmed edge.

19. A siding assembly for a building exterior, comprising:

an elongated base strip having an L-shape with a first leg for fastening to an exterior wall of a building and a second perpendicular leg extending outwardly from the exterior wall;

siding strips overlying the first leg of the base strip and being secured to the exterior wall of the building; and an elongated cover strip having an L-shape with a first leg extending along the second leg of the base strip and a second leg covering ends of the siding strips in spaced relating to the first leg of the base strip;

the base strip and the cover strip being separate pieces and assembled to form an elongated, continuous J-shaped channel in which ends of the exterior siding strips reside; and fasteners extending through the cover strip and into the siding strips.

* * * * *